US005947636A

United States Patent [19]

Mara

[11] Patent Number: 5,947,636

[45] Date of Patent: Sep. 7, 1999

[54] RAPID ROAD REPAIR VEHICLE

[75] Inventor: Leo M. Mara, Livermore, Calif.

[73] Assignee: Sandia Corporation, Livermore, Calif.

[21] Appl. No.: 08/989,901

[22] Filed: Dec. 12, 1997

Related U.S. Application Data

[63] Continuation-in-part of application No. 08/496,274, Jun. 28, 1995, Pat. No. 5,746,539.

[51] Int. Cl.[6] ..... E01C 19/18; E01C 23/07

[52] U.S. Cl. ..... 404/84.05; 404/102; 404/111

[58] Field of Search ..... 404/72, 75, 84.05, 404/84.1, 84.5, 101, 104, 108, 111, 102

[56] References Cited

U.S. PATENT DOCUMENTS 5,439,313 8/1995 Blaha ..... 404/75

5,746,539 5/1998 Mara ..... 404/84.05

*Primary Examiner*—James A. Lisehora

*Attorney, Agent, or Firm*—Timothy Evans; Kurt Olsen

[57] ABSTRACT

Disclosed are improvments to a rapid road repair vehicle comprising an improved cleaning device arrangement, two dispensing arrays for filling defects more rapidly and efficiently, an array of pre-heaters to heat the road way surface in order to help the repair material better bond to the repaired surface, a means for detecting, measuring, and computing the number, location and volume of each of the detected surface imperfection, and a computer means schema for controlling the operation of the plurality of vehicle subsystems. The improved vehicle is, therefore, better able to perform its intended function of filling surface imperfections while moving over those surfaces at near normal traffic speeds.

13 Claims, 4 Drawing Sheets

RAPID ROAD REPAIR VEHICLE

This application is a Continuation-in-Part (CIP) of U.S. patent application Ser. No. 08/496,274, filed Jun. 28, 1995, U.S. Pat. No. 5,746,539, the contents of which are herein incorporated by reference.

STATEMENT OF GOVERNMENT INTEREST

This invention was made with Government support under Contract No. DE-AC04-94AL85000 awarded by the U.S. Department of Energy to Sandia Corporation for the management and operation of the Sandia National Laboratories. The Government has certain rights in this invention.

FIELD OF THE INVENTION

The present invention relates to an improved rapid road repair vehicle that analyzes and repairs surface imperfections in roads as the rapid road repair vehicle is moving over the surface being repaired. It is self-propelled and uses very rapidly setting road repairing materials which can be applied by the vehicle after sensors recognize any blemish and a computerized solution is transmitted to the valve/nozzle array which can then dispense any of a variety of rapid setting road patching materials to the site to be repaired.

BACKGROUND OF THE INVENTION

Potholes, cracks, and other road problems associated with road surface deterioration are encountered very often on highways and other paved surfaces such as airport runways or parking lots, especially where there is a heavy traffic pattern over the surface by heavy vehicles. The conventional methods for repairing these road surfaces require a significant amount of labor intensive activity to repair these surfaces and even then the repairs are many times of questionable quality and questionable durability. This process is time consuming and poses a significant impediment to traffic flows that are very costly in terms of delays and safety hazards. Typically, one or more workers walk along the road surface to observe road surface problems and direct the driver of a vehicle to position the dispenser on a truck over the problem area in the road surface to dispense material which is many times tamped into place by hand. This labor intensive process is expensive in terms of time expended and the number of times the process must be repeated to finally fix the surface sufficiently to accommodate the traffic pattern. This process is also a problem in that many repair people are exposed to potentially harmful chemical substances and the threat of bodily injury from their equipment as well as the traffic in which they are working.

U.S. Pat. Nos. 5,294,210 and 5,364,205 describe a method and an apparatus for automated pothole sensing and filling having a starting level of automation to handle the finding and filling of potholes. This equipment is limited to finding and filling larger holes which may involve only large translation of sensors and outlets for filling materials. It would only be suitable for dispensing molten asphalt or similar materials which would require considerable set and cure times. This would also require stopping the vehicle to accomplish the task in an efficient way and sectioning off whole segments of the highway to keep vehicles from getting into the repairs too soon. This would slow traffic patterns to an extent that there would be little value added with the use of such equipment which may explain why it has not been adopted for large scale use.

SUMMARY OF THE INVENTION

The present invention is an improved rapid road repair vehicle that analyzes and repairs surface imperfections in roads at as the rapid road repair vehicle is moving over the surface being repaired. It is self-propelled and uses very rapidly setting road patching materials which can be applied by the vehicle after sensors recognize a problem. A solution is computed by a computer means and transmitted to an array of valves/nozzles connected to repair material storage tanks which can then dispense the appropriate and correct amount of repair directly onto the damaged site. The present invention includes a sophisticated array of sensors to detect the type of problem as well as measure the amount of materials needed to repair the problem. Also included are a set of road surface cleaning devices to assure a high quality repair that will not have to be repeated as often as is presently the case with such road repairs.

It is therefore a primary object of the present invention to provide an improved rapid road repair vehicle that will significantly enhance the quality of road repairs.

It is another object of the present invention to provide an improved rapid road repair vehicle which will significantly enhance the convenience of making road repairs at a significant savings.

It is a further object of the present invention to provide an improved rapid road repair vehicle which can easily be adapted to use with various types of highways to minimize the impact of the repairs on the traffic flow and improve the health and safety for the traveling public as well as the repair crews.

It is still another object of the present invention to provide an improved rapid road repair vehicle that can be operated by one person using one piece of equipment and operated at any time of the day or night that would reduce human exposure to potentially harmful chemical substances.

It is still a further object of the present invention to provide an improved rapid road repair vehicle that could repair roads much faster, cheaper, with higher quality, more safely, and with little or no loss of traveler's time or disruption of traffic flows.

These and other objects of the present invention, will become apparent to those skilled in this art upon reading the accompanying description, drawings, and claims set forth herein.

DETAILED DESCRIPTION OF THE INVENTION

First Embodiment

Figure 1:
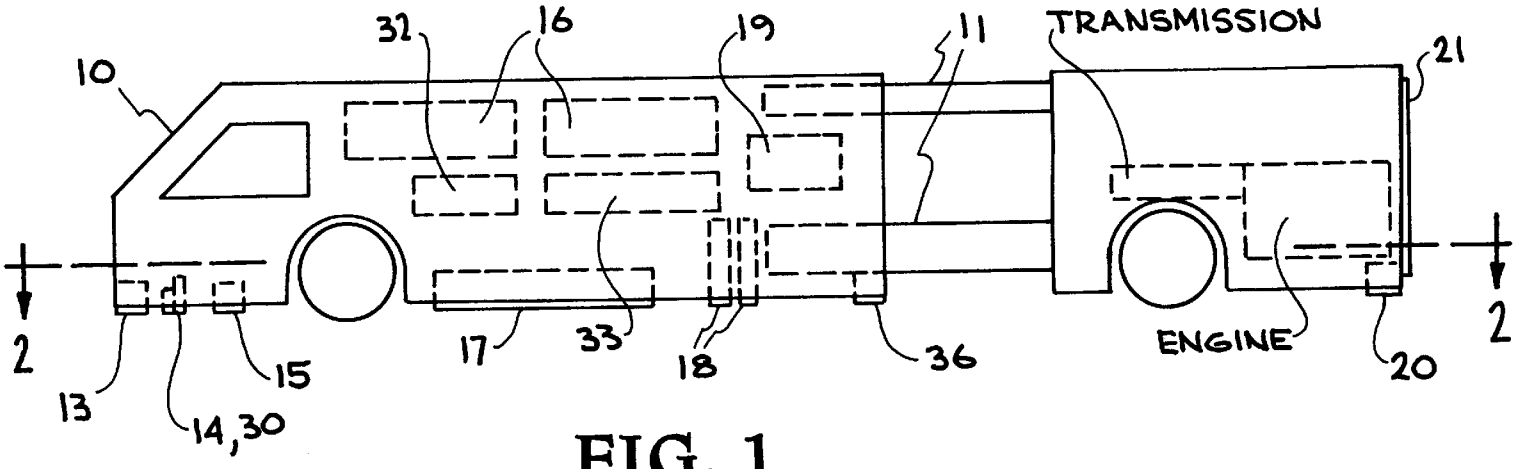
FIG. 1 is a side view of the rapid road repair vehicle according to the present invention.
Figure 2:
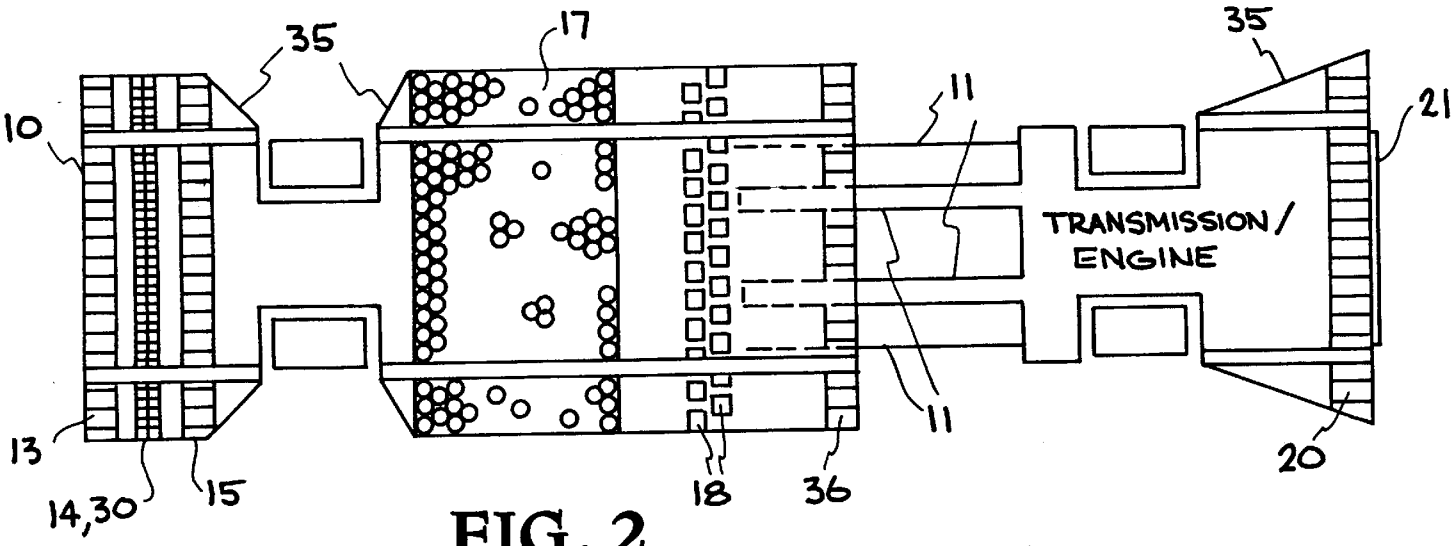
FIG. 2 is a sectional view of the rapid road repair vehicle of the present invention taken along line 2—2 of FIG. 1.

FIG. 1 shows a side sectional view of the rapid road repair vehicle 10 according to the concepts of the present invention. As can be amply seen from the drawings the rapid road repair vehicle 10 is variable in length to accommodate both the curing time of repair materials and its own maneuverability by means of chassis slides 11. The rapid road repair vehicle 10 would be make shorter for self-transport and for use in places like city streets, where low speed operation would be suitable by means of the chassis slides 11 which may conveniently be hydraulic cylinders for automatic operation of the change in length of the rapid road repair vehicle 10. It can be easily lengthened by the operator for use on highways at significantly greater speeds or slower curing patching materials by use of the chassis slides 11. The added length provides the necessary time barrier to protect the road repairs from on-coming traffic at higher traffic speeds. The rapid road repair vehicle 10 can be equipped with foldable wing panels 35 as amply seen on FIG. 2 of the drawings that serve as width extensions of the scanners, dispensers, etc. to accommodate wider surfaces to be repaired. This allows for easy transport of the rapid road repair vehicle 10, as well as repair of up to three road widths.

A first row of range scanners 13 are mounted in the front of the rapid road repair vehicle 10 to scan the road surface for imperfections that need to be repaired. An example of a preferred scanner for this application is the RS 2200 Ranger high-speed range scanner available from Metolius Inc., 14127 125th Ave., Kirkland, Wash. 98034. This system exhibits low cost, high performance and a high scanning rate making it ideal for application in this invention. Defects are identified and recorded, using a triangulation measurement method, as the vehicle-mounted scanning laser beam(s) contained within the scanners pass over the defective surface. This type of scanner also permits the rapid road repair vehicle to make measurements at speeds of 35 miles per hours to measure the volume of any sighted defect cavity allowing the rapid road repair vehicle computer means to calculate the amount of patching material needed to properly repair the damaged surface. Behind the first row of scanners 13 there can be seen in the drawings a row of cleaning devices 14 and 30 to clean the surfaces to be repaired to assure good adhesion of the patching materials to be applied to the imperfection in the road surface. The row of cleaning devices 14 and 30 may include high-pressure air in the leading row followed by vacuum in the trailing row to effect good quality cleaning of the surface of all loose materials as well as vacuuming these materials into a debris storage area 33. Following the row of cleaning devices 14 and 30 is a second row of scanners 15. This second row of scanners 15 feed additional data to the rapid road repair vehicle 10 as to select the proper amount of materials for the repair and to position the rapid road repair vehicle 10 to perform the repair.

The rapid road repair vehicle 10 carries tanks 16 of varying road repairing materials which are plumbed to interwoven arrays of fast-acting pneumatically dispensing valves/nozzles 17. The interwoven arrays of fast-acting pneumatically dispensing valves/nozzles 17 are located at an appropriate distance behind the second row of scanners 15 to allow for the processing of the information necessary to activate the appropriate fast-acting pneumatically dispensing valves located in interwoven arrays 17. Following the interwoven arrays of fast-acting pneumatically dispensing valve/nozzles 17 are several rows of pneumatically actuated Teflon shoed road surface tampers 18 to smooth the resulting road surface and to compact the materials applied to the road surface imperfections to obtain a good road surface condition. The rapid road repair vehicle has a air compressor 19 and a vacuum pump 32 to power the associated equipment on the rapid road repair vehicle 10 in response to the information collected and transmitted to the repair components so that the rapid road repair vehicle 10 may move at a high-speed while completing repairs to at least an entire lane at one time. The final step in the rapid road repair vehicle 10 process will require a third row of scanners 20 at an appropriate distance from the interwoven arrays of fast-acting pneumatically dispensing valves/nozzles 17 to check its performance and log road conditions against time and location for any future reference/work, if needed. This can include a Global Positioning System known as GPS in conjunction with the scanners 20 to map the precise location as well as the time and surface conditions. Mounted on the rear of the vehicle, facing traffic, is a flip dot display sign 21 warning motorist of the repair work, and to keep their distance. This flip dot display sign 21 could be used to inform approaching motorists of the speed of the rapid road repair vehicle 10, or to display any other information.

Complications arising from curves in the roadway, such as misalignment of scanners 13, 15 or 20 and repair equipment on the rapid road repair vehicle 10, would be addressed by monitoring changes in the rapid road repair vehicle steering angle.

The rapid road repair vehicle 10 will carry out its task in the following sequence. The first row of scanners 13 provide optical recognition of road surface damage or imperfections. A dedicated on-board processor measures and calculates the volume of affected area. Cleaning of the damaged area is facilitated with a row of high-pressure gas and/or high vacuum cleaning devices 14 and 30. The area of interest is then re-measured and the volume re-calculated using the second row of scanners 15. An on-board computer can be used to choose the appropriate course of action based on the gathered data, i.e. possibly apply a priming coat, fill the hole or crack with the appropriate material(s), or don't repair and note the damage to a log for further action later. The appropriate fast-acting pneumatically dispensing valves/nozzles located within interwoven arrays 17 would be activated according to the chosen course of action, dispensing any of a multiplicity of road repair materials. To ensure a smooth finish the suitable Teflon shoed road surface tampers 18 would be activated. The application of a finishing coat/sealer, or to ensure a non-slip finish, a suitable grit could be applied to the surface, if required, by a row of dispensers 36 as seen in the drawings. A third row of scanners 20 checks the repair and the rapid road repair vehicle 10 performance. Maps of the road's condition using the gathered data are recorded for future analysis and for maintenance records.

The problems addressed by the rapid road repair vehicle 10 are many as can be easily seen by those skilled in this art. The rapid road repair vehicle 10 lessens traffic congestion and the avoidance of road closures during road surface repairs. The rapid road repair vehicle 10 detects and fixes small roadway irregularities early, avoiding their escalation and lowering the cost of repair. The rapid road repair vehicle 10 saves labor and equipment costs. The rapid road repair vehicle 10 saves wear and tear on the components of motor vehicles that deal with "Pot Holes". The rapid road repair vehicle 10 conceivably helps to avoid accidents and saves lives due to poor road conditions. The rapid road repair vehicle 10 conceivably saves lives of road repair workers by not exposing them to the hazards of traffic or the potentially harmful chemical substances used to repair such surfaces. The rapid road repair vehicle 10 will find wide spread use anywhere roads or other similar surfaces are presently repaired by a crew of workers in time consuming hand labor they could be repaired by one operator with the minimal skills of a bus/truck driver. The repairs would be accomplished using one piece of equipment that could be operated any time of the day or night. Roads could be fixed much faster, cheaper, and more safely, with little or no disruption to traffic or loss of travelers' time. Road repair is the responsibility of governments large and small all over the world. The recognition part of this system could be installed on any vehicle at any time and would be used to map road conditions that might have military applications as well as civilian. Private industry would be employed to build the many units required. Although the cost of high-speed patching material is high, the largest part of the cost of repairing roads is the labor, which would be greatly reduced. The savings in indirect costs would also be considerable, such as avoidance of closing high volume traffic lanes or freeways, less fuel consumption when traffic flows smoothly, less wear and tear on brakes and other parts due to stop-and-go driving, avoids drivers stress, which in turn affects business productivity and mental health.

Thus it will be appreciated by those skilled in the art that the present invention is not restricted to the particular preferred embodiments described with reference to the drawings, and that variations may be made therein without departing from the scope of the present invention as defined in the appended claims and equivalents thereof.

Second Embodiment

Figure 4:
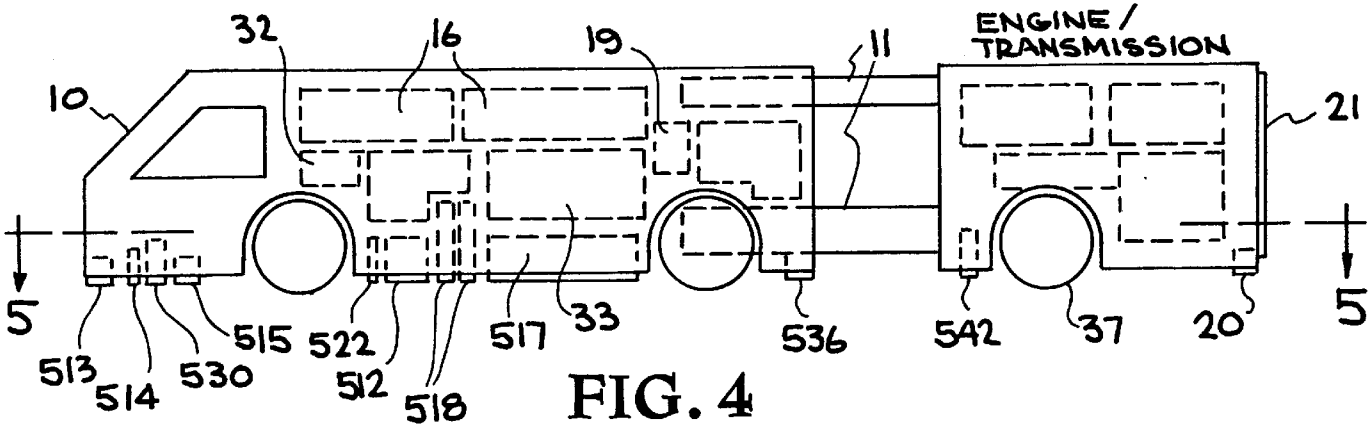
FIG. 4 [RRRV1UD1.Dwg] shows a side view of the rapid road repair vehicle showing the physical relationships of the major hardware components of the rapid road repair vehicle. A section line 5 is indicated.
Figure 5:
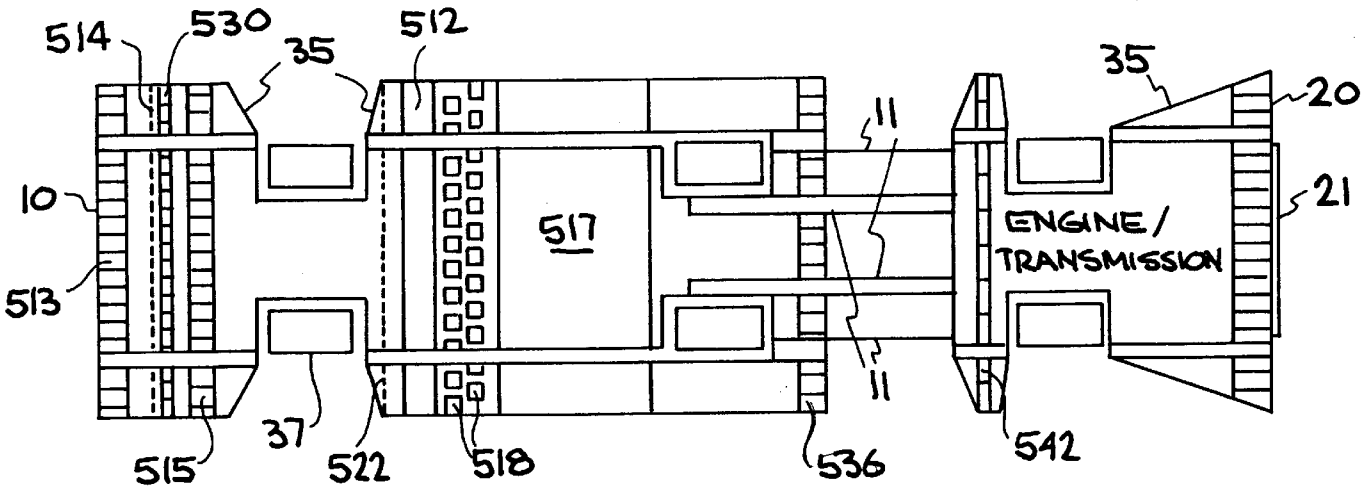
FIG. 5 [RRRV2UD1.Dwg,] shows a sectional view of the rapid road repair vehicle showing the placement of scanners, valves/nozzles and tampers taken along line 5—5 in FIG. 4.

An alternate embodiment for the rapid road repair vehicle is shown in FIG. 4. Much is common between the first and second embodiments. As described in the first embodiment, the second embodiment more clearly seen in FIG. 5, also includes an array 513 of contiguous, range scanners spanning the width of the rapid road repair vehicle and located under the front edge of the vehicle. Again, scanner array 513 comprises a plurality of individual scanning cameras each further comprising individual optics. As in the first embodiment, a second row of scanners 515 is located a short distance behind the first row. Between the two rows of scanners are located the cleaning devices: the row of high-pressure air valves/nozzles 514 and the adjacent row of vacuum valves/nozzles 530.

Unlike the first embodiment, a row of heating elements 522, discussed in more detail later, spans vehicle chassis and foldable wing panels immediately behind the first set of support tires 537. A first array 512 of fast-acting valve/nozzle assemblies for dispensing aggregate follows a short distance behind the heaters. A second and larger array 517 of the fast-acting valve/nozzles, this array for handling one of several patching compounds, follows the first. The two arrays span the width of the vehicle and the foldable wings and are separated from each other by a distance sufficient to allow placing at least two rows of tampers 518 between the two arrays.

The alternate embodiment also includes a vehicle having a third axle and a third set of doublewide tires 537 at the mid-section of the vehicle. Also included is a second row of cleaning devices: vacuum valves/nozzles 542 located just aft of the chassis slides 511 but ahead of the rear axle/tire assembly.

Figure 3A:
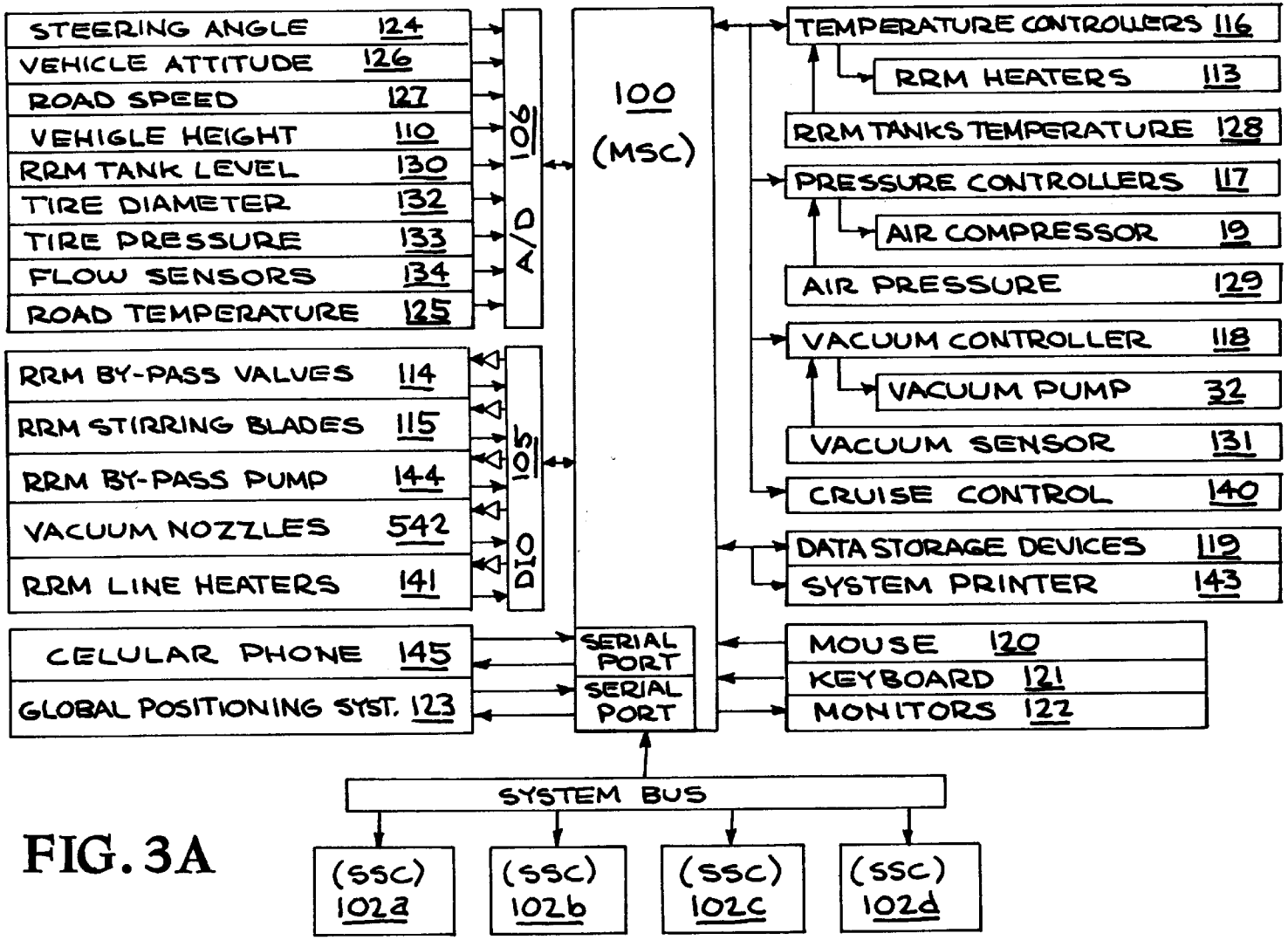
FIGS. 3*a* and 3*b* [RRRVScm1.Dwg RRRVScm2.Dwg] shows the computer architecture schema for the control system that would operate the rapid road repair vehicle.
Figure 3B:
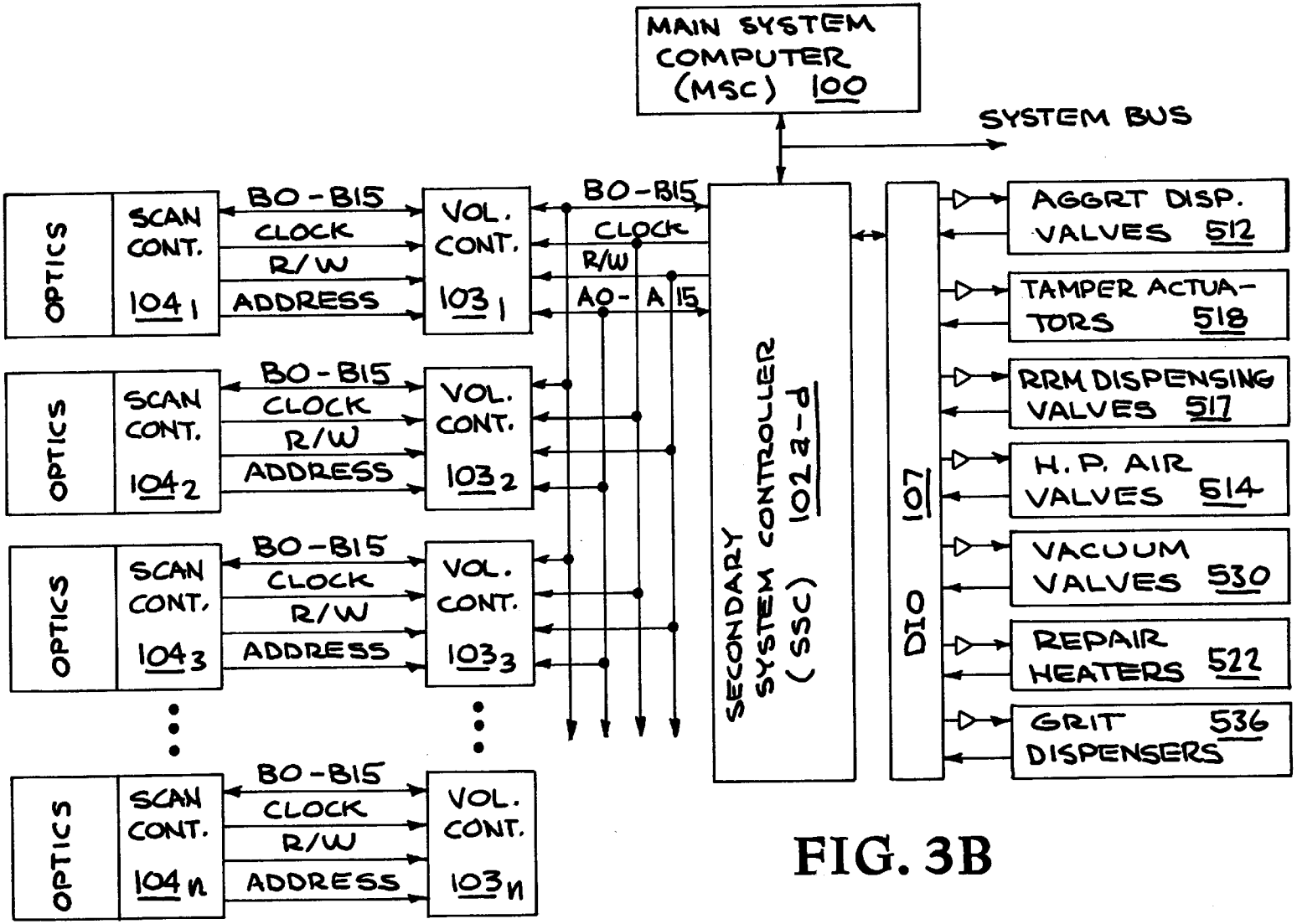

As shown in FIG. 3*b*, the second embodiment discloses individual matrix array picture processors 104 and an associated individual volume measuring microprocessor 103 coupled with individual scanner optics.

The scanner array 513 performs an initial scan and optically locates and identifies roadway surface damage. The plurality of dedicated onboard volume measuring microprocessors $\mathbf{103}_f$–$\mathbf{103}_n$ measure and calculate the volume of the affected area. As before, an example of a preferred scanner is the RS 2200 Ranger high-speed range scanner available from Metolius Inc., 14127 125th Ave., Kirkland, Wash. 98034

The damaged area is cleaned and/or tested for rigidity with high-pressure air and/or vacuum. The high-pressure air and vacuum are provided by an onboard air compressor 519 and vacuum pump 532 respectively. The high-pressure air is directed at any imperfection detected by scanner array 513 through a plurality of contiguous high-pressure air valves/nozzles 514 located several feet aft of, and arranged in a row parallel to, scanner array 513 to dislodge loose material. A similar row of vacuum valves/nozzles 530, through which vacuum is applied, remove debris from damaged areas.

The operation of a sub-group of high-pressure air valves/nozzles 514 and vacuum valves/nozzles 530 is controlled by one of four secondary system controllers 102*a*–102*d*. Each controls a share of the vacuum valves (not shown) attached to vacuum valves/nozzles 530 and high-pressure air valves (not shown) attached to high-pressure air valves/nozzles 514. Debris gathered from the cleaning step is internally conveyed into debris storage tanks 533 for disposal or recycling.

Each area of damage detected along the roadway and which is identified in the initial scan, as well as its surroundings is re-scanned by a second row of scanners 515 and the volume of the surface damage recalculated. Any changes in shape and/or volume are noted and factored into subsequent computations of required patch extent. The associated secondary system controllers 102*a*–102*d* determines an appropriate course of action based on the data gathered from associated volume measuring microprocessor $\mathbf{103}_f$–$\mathbf{103}_n$, the main system computer 100, and other sensors.

Located behind scanners 515 is a row of zone heaters 522 spanning the width of the vehicle. Heaters 522 are either radiant, infrared, or microwave sources and their purpose is to help prepare the road surface in the vicinity of the located damage by heating it thereby making the surface more receptive to bonding with the various patching materials. Behind the heaters 522 are two arrays 512 and 517 of fast-acting pneumatically valve/nozzle assemblies spanning the width of the rapid road repair vehicle. Array 512 is designed to handle aggregate and is used to fill gross damage. Array 517 dispenses one or several patching compounds herein referred to as road repair materials. Each of arrays 512 and 517 comprise a plurality of interwoven and independently addressable valves/nozzles to apply an amount of repair material to the surface damage to be repaired; that is, the operation of each valve is controlled by one of the four secondary system controllers 102*a*–102*d*. Each secondary system controllers interprets the output from the subset of scanner elements associated with it and "maps" the "image" or pattern of the identified roadway damage onto that portion of each array 512 and 517, controlled by the associated secondary system controller, as the arrays passes over the damage. The operation of the valve arrays is synchronized with this "image" as it traverses the array actuating only those valves in each array under which the "image" passes and only for so long as is necessary in order to dispense an amount of aggregate/patch material which the volume measuring microprocessor 104 has calculated to be adequate to fill the defect OR only for so long as it is possible for any one is valve to dispense material before the forward progress of the vehicle moves it away from the damage. In the latter case, later following adjacent valves are activated after the former are closed in order to continue filling the damaged site. This process is then continually repeated until the defect has been properly filled.

As before, some of the possible courses of actions are: 1) Partially fill any large hole with aggregate, using aggregate valve array 512; 2) apply the appropriate road repair material and/or sealer(s) to the hole/crack through valve array 517; or 3) choose not to repair the damage, and either record it on one of the data storage devices 119 and/or report it through the onboard Cellular Phone 145, as appropriate.

Aggregate valve array 512 is most often used to dispense an aggregate filler to pre-fill any large hole. However, it might also be employed to dispense a primer, special adhesive, the first part of a two part filler, or other road repair materials.

Located directly behind the aggregate valve array 512 are several rows of pneumatically actuated, Teflon shoed tampers 518. After dispensing an appropriate quantity of the aggregate/sealer/road repair materials, those tamper(s) moving above the location of the dispensed patch are selected/actuated by appropriate associated secondary system controllers 102*a*–102*d* to smooth and/or pack aggregate/sealer/road repair materials dispensed through aggregate valve array 512.

Accordingly, secondary system controllers 102*a*–102*d* determine a course of action. If a decision is made to proceed with repair, the damaged area is "mapped" and the appropriate pattern of valve(s) in arrays 512 and 517 are selected and then activated, dispensing road repair materials/sealer to fill the detected hole or crack. The location of the damage, the shape of the imperfection, and its total volume of the damage determine the choice of which valve(s) in arrays 512 or 517, is/are activated. For example, if the void to be filled were a small hole/crack, only valves passing over it in the first few rows of array 517 are activated. The duration of any particular valve's activation is dependent on the speed of the rapid road repair vehicle and the longitudinal size and void volume of the roadway defect, parallel to the direction of the rapid road repair vehicle travel at an instant in time. In the case of a large hole, more of the valves passing over it, both in array 512 and array 517, would be activated. Therefore, each valve in turn, row by row, would add its portion of the total material needed to fill a large hole: the larger the size/volume of the damage, the greater the number of valves used and the longer the duration of their activation.

The application of a finishing coat/sealer, dispensed through valve array 517, would be initiated, if required. To ensure a non-slip finish, suitable grit, distributed by dispensers 536, can be selected and activated. Finally, vacuum cleaning, applied through a second row of vacuum valves/nozzles 542, is initiated to clean any loose debris. A final row of range scanners 520 checks the repair and the rapid road repair vehicle performance.

In addition to repairing roadway damage, a map of the road's condition is recorded on removable data storage media 119. This map consists of the gathered data, actions taken, and materials used, along with location information from the on-board Global Positioning System 123. These maps are then utilized for future analysis and maintenance records. Surface damage beyond the scope of a single pass of the rapid road repair vehicle is computationally determined by main system computer 100, a decision not to repair is made, and the location transmitted via cellular phone 145 to an emergency repair crew. Alternatively, multiple passes could be made with the rapid road repair vehicle.

The scanners 513, 515, 520 constantly scan the roadway surface as the rapid road repair vehicle passes over it. The information gathered by the matrix array picture processors $\mathbf{104}_a$–$\mathbf{104}_n$ is passed to, and analyzed by the volume measuring microprocessors $\mathbf{103}_l$–$\mathbf{103}_n$, each of which determines the volume and shape of any road surface damage observed by its associated scanner 513, 515. Should any such damage be detected by any/all volume measuring microprocessor $\mathbf{103}_l$–$\mathbf{103}_n$, that information would be relayed to its/their secondary system controllers 102*a*–102*d*. Because the secondary system controllers 102*a*–102*d* would know the location and spacing of each scanner, it could assemble the data received from the volume measuring microprocessor $\mathbf{103}_l$–$\mathbf{103}_n$ into a very accurate picture of any area of interest Scanner array 513 would provide a reference picture. Scanner array 515 would provide a picture of the effects of high-pressure air and/or vacuum. Finally, scanner array 520 would provide feedback to the system about the final result. Thus, having these "pictures", each secondary system controllers 102*a*–102*d*, together with the main system computer 100, would decide on, and direct the response of the rapid road repair vehicle repair sub-systems.

The main system computer 100 would oversee the entire operation of the rapid road repair vehicle. As shown in FIGS. 3*a* and 3*b*, each of vehicle sub-systems would be controlled by, and would report to, the main system computer 100 through appropriate software means. The computer 100 directly controls the non-time-critical peripheral devices through multiple channels of the several Digital Input/Output Interfaces (DIOI) 105 and Analog to Digital Converter Interfaces (A/D) 106. The main system computer 100 communicates through a 32-bit system bus tied very closely with the main support components, the four secondary system controllers 102*a*–102*d*.

Through the DIOI's 105 and their associated hardware drivers the main system computer 100 controls the road repair materials by-pass valves 114, the road repair materials by-pass pump 144, the final cleaning vacuum valves 142, the road repair materials line heaters 141, and the road repair materials stirring blades 115 (located inside road repair materials tanks 16).

Through A/D 106, the main system computer 100 monitors various non-time-critical functions associated with vehicle performance, including the vehicle's steering angle sensor 124, the road speed sensor 127, and the vehicle's attitude sensor 126 and the vehicle's height sensor 110. In addition, the main system computer 100 monitors the ambient road surface temperature through temperature sensors 125, the vehicle's tire diameter through sensors 132 and tire pressure through sensors 133, the road repair materials tanks content level though sensors 130, and the road repair materials flow through sensors 134. Through its 16-bit address and data buses the main system computer 100 monitors and controls the non-time-critical functions associate with the temperature controllers 116 maintaining proper repair material temperature and viscosity. The main system computer 100 also monitors and controls the pressure controllers 117 and vacuum controllers 118 for maintaining an adequate pressure head for proper performance of high-pressure valve/nozzle array 514 and vacuum valve/nozzle arrays 530 and 542, and lastly the vehicle's cruise control 140.

Standard peripheral devices such as monitors 122, a keyboard 121, a mouse 120, a printer 143, and various (mass) data storage devices 119, are interfaced to the main system computer 100 in the usual way. Additionally, two communication devices are interfaced through the main system computer 100 serial ports. These include a global positioning query system 123, and a cellular phone 145.

Through a 32-bit system bus the main system computer 100 would communicate very closely with its secondary system controllers 102*a*–102*d*. The secondary system controllers 102*a*–102*d* would be micro-controllers/microprocessors. They would take care of all the rapid road repair vehicle time-critical functions. They would receive their initialization and operating instructions from the main system computer 100, as well as periodic updates. These updates would include road speed, steering angle, patch/don't patch, and other control commands.

As shown in FIG. 3*b*, activation and control of the actuators driving the pneumatic tamper array 518, the valve/nozzle arrays 517 and 512, and high-pressure air valve array 514 and vacuum valve array 530 is maintained by the secondary system controllers 102*a*–102*d* through their DIOI port(s) and associated hardware drivers. Also controlled is the rows of heaters 522 and of grit dispensers 536. Not shown are the plurality of individual actuator connections for each of the above arrays of devices which allow the pattern of the road surface defect to be "bit-mapped" onto each of the arrays, actuating only those actuators so mapped, as each progressively passes over said defect.

Through their 16-bit address and data busses the secondary system controllers 102*a*–102*d* would monitor and control the volume measuring microprocessor $\mathbf{103}_l$–$\mathbf{103}_n$. Subsequently, the volume measuring microprocessor $\mathbf{103}_l$–$\mathbf{103}_n$ would monitor and control the scanners $\mathbf{104}_l$–$\mathbf{104}_n$ which would get their "picture" through the optics in arrays 513, 515, and 520 of the rapid road repair vehicle.

The choice of which of the tampers 518 to actuate, and for what length of time, would be the decision of one of the secondary system controllers 102*a*–102*d*. Each of the four secondary system controllers 102*a*–102*d* would control approximately seven tampers. A tamper actuator 18 would be tied to its own channel on one of the DIOIs 107 associated with a secondary system controllers 102*a*–102*d*. This gives a particular secondary system controllers 102*a*–102*d* individual control of each tamper attached to it.

The same would be true of the high-pressure air valve array 514, the Vacuum valve array 530, the road repair materials dispensing valves/nozzle array 517, the aggregate dispensing valve/nozzle array 512, and the Repair Heaters 522. The control of these approximately 1000 digital input/output lines would be divided among the four secondary system controllers 102*a*–102*d*.

The angle of the steering wheel would be monitored with a Steering Angle Sensor 124 through an A/D 106 by the main system computer 100. This would accommodate repairs performed while the rapid road repair vehicle negotiates any curve in a road. Because the scanner arrays 513, 515 would be located some distance from the valve/nozzle arrays 512, 517 and tampers 518, the "picture" of any damage could not be mapped correctly unless the forward motion of the rapid road repair vehicle is invariant during its transit over the detected imperfection. Further, appropriate compensation must be made for any variation in steering angle and/or speed of the rapid road repair vehicle and that information passed from the main system computer 100 to each of the secondary system controllers 102*a*–102*d*. Such information is important in order to accurately direct the patterns and duration of activation of the separate valves in valve/nozzle arrays 512, 517 and in tampers 518.

The speed of the rapid road repair vehicle is controlled by a very accurate cruise control 140 and monitored with a road speed sensor 127. Cruise control 140 would communicate with the main system computer 100 over its 16-bit address and data buses, while the road speed sensor 127 would be read through an analog-digital converter (A/D) 106. The timing of the activation of the dispensing arrays 512, 517, cleaning arrays 514, 530, 542 and tampers 518 are crucial to the rapid road repair vehicle operation. This timing is tied directly to the speed of the rapid road repair vehicle. For example, in order for a valve in the array 517 to hit a target, its assigned secondary system controllers 102*a*, 102*b*, 102*c*, or 102*d* must know how long to wail before sending the command to open that valve. The length of that hiatus is a function of the vehicle's speed and would be calculated by the main system computer 100 and then downloaded to each of the secondary system controllers 102*a*–102*d* for use in their timing calculations.

The rapid road repair vehicle is intended to be suspended on an air ride system that would allow for height as well as attitude adjustments. The height adjustment facilitates the transport of the vehicle. It would be raised to move it from place to place and be adjusted to an appropriate working height during operation.

The attitude of the rapid road repair vehicle would be monitored with an attitude sensor 126, through an A/D 106, by the main system computer 100. The function of attitude sensor 126 is to supply real-time information to the main system computer 100 regarding to the relative position of the rapid road repair vehicle with respect to the road surface. In the event of an uneven road surface, or, if one wheel should fall into a deep hole, the position of the rapid road repair vehicle lower deck would change enough to make it computations taking place at that moment inaccurate. In such a case the main system computer 100 could abort current commands and determine not to repair any damage and simply record the event. Using appropriate feedback controls attitude adjustments could be made to compensate for minor uneven surface conditions encountered during slow speed repairs to heavily damaged surfaces.

What is claimed is:

1. An improved rapid road repair vehicle comprising:

a vehicle capable of traveling over a surface to be repaired, said vehicle having front and rear ends and an undercarriage, said vehicle further having tires mounted on forward and rearward wheel/axle assemblies, said assemblies mounted onto said undercarriage for supporting said vehicle;

a first row of scanners attached to said vehicle undercarriage near said front end, said scanners capable of detecting and measuring at least one surface imperfection in the surface to be repaired;

a row of cleaning devices attached to said vehicle undercarriage behind said first row of said scanners, said cleaning devices for cleaning the surface imperfection;

a second row of scanners attached to said vehicle undercarriage behind said row of cleaning devices, said second row of scanners for re-measuring the cleaned imperfection, and for calculating the volume of the surface imperfection;

a first array of fast-acting pneumatically dispensing valves/nozzles attached to said vehicle, said array comprising a plurality of interwoven and independently addressable valves/nozzles to apply an amount of aggregate repair material to the surface imperfection to be repaired;

a row of surface tampers attached to said vehicle undercarriage and located behind said first array, said tampers for smoothing the surface of the repaired surface imperfection;

a second array of fast-acting pneumatically dispensing valves/nozzles attached to said vehicle located behind said tampers, said second array comprising a plurality of interwoven and independently addressable valves/nozzles to apply an amount of repair material to the surface imperfection to be repaired;

a row of dispensing valves/nozzles attached to said vehicle undercarriage and located behind said second array, said dispensing valves/nozzles for applying a finish coat/sealer over the repaired surface imperfection;

computer means for addressing and simultaneously controlling the operation of each of said fast-acting pneumatically valves/nozzles comprising said first and said second arrays, wherein a volume of repair material equivalent to the measured volume of the surface imperfection is dispensed into said imperfection by the operation of one or a succession of said valves/nozzles within each said array as said arrays move over said surface imperfection, said computer means for further addressing and controlling the operation of said dispensing valves/nozzles; and a third row of scanners attached to said vehicle undercarriage near said vehicle rear end, said third row of scanners for recording and cataloging the repair work.

2. An improved rapid road repair vehicle according to claim 1, wherein said first and second row of scanners comprise a plurality of high-speed laser scanners, each said scanner further including individual optics elements, a matrix array picture processor, and an associated microprocessor, each said microprocessor including software means for identifying, measuring, and calculating the volume and shape of said surface imperfections.

3. An improved rapid road repair vehicle as in claim 1 wherein said computer means further comprises software means, said software means for:

calculating the relative position, speed, and probable path of said surface imperfection, with respect to said valves/nozzles comprising said first and second arrays, as said road repair vehicle passes over said surface imperfection;

calculating the number, array location, and sequence of operation of each said nozzle comprising said first and second arrays which will pass over said surface imperfection;

calculating the amount and type of repair materials dispensed by each said nozzle;

calculating the duration each said nozzle will dispense said repair material; and controlling and synchronizing the sequential operation of each said nozzle as it passes over said surface imperfection.

4. An improved rapid road repair vehicle as in claim 1, further comprising a row of repair heating elements, said heating elements attached to the vehicle and located between said second row of scanners and said first array.

5. An improved rapid road repair vehicle as in claim 4 wherein said repair heating elements comprise either incandescent radiant energy producing elements, infrared producing elements, or a plurality of microwave sources.

6. An improved rapid road repair vehicle according to claim 1, wherein said data from said third row of scanners is recorded along with a global positioning satellite location and a universal clock time to catalog the repair surface history.

7. An improved rapid road repair vehicle according to claim 1, wherein said cleaning devices include a leading row of air pressure devices and a trailing row of vacuum devices to remove all loose material from the surface imperfections found in preparation for the repair to be effected.

8. An improved rapid road repair vehicle according to claim 1, wherein said vehicle includes a means for altering the length of said vehicle to accommodate the setting time of the repair material being used and the speed of the vehicle over the surface to be repaired.

9. An improved rapid road repair vehicle according to claim 1, wherein said vehicle has means for altering the said vehicle width in order to accommodate a change in width of the surface to be repaired.

10. An improved rapid road repair vehicle according to claim 9, wherein said means for altering said vehicle width comprises a set of wings extending along the length of each side of said vehicle and wherein each set of wings further comprises extensions of said first, second and third rows of said scanners, said row of said cleaning devices, said first and second arrays, said row of said tampers, said row of said dispenses valves/nozzles, and said row of said heaters.

11. An improved rapid road repair vehicle as in claim 1 further comprising a second row of vacuum valves/nozzles for cleaning the repaired road surface, said second row of vacuum valves/nozzles attached to said vehicle and located between said row of dispensers and said third row of scanners.

12. An improved rapid road repair vehicle as in claim 1 further including a third set of tires mounted on a third wheel/axle assembly, said assembly located midway between said forward and said rearward wheel/axle assemblies.

13. An improved rapid road repair vehicle according to claim 1, wherein said vehicle has a display sign on its rear end to warn traffic of the repairs in process.

* * * * *